US005355582A

United States Patent [19]

Saito et al.

[11] Patent Number: 5,355,582

[45] Date of Patent: Oct. 18, 1994

[54] METHOD OF FABRICATING TERMINAL CONNECTED LEADS

[75] Inventors: Toshimasa Saito; Yuji Hatagishi, both of Shizuoka, Japan

[73] Assignee: Yazaki Corporation, Tokyo, Japan

[21] Appl. No.: 141,686

[22] Filed: Oct. 26, 1993

Related U.S. Application Data

[63] Continuation of Ser. No. 886,589, May 21, 1992, abandoned.

[30] Foreign Application Priority Data

May 31, 1991 [JP] Japan ..... 3-129257

[51] Int. Cl.[5] ..... H01R 43/04

[52] U.S. Cl. ..... 29/863; 29/33 M; 29/748; 29/884

[58] Field of Search ..... 29/33 M, 861–866, 29/874, 876, 884, 747, 748, 754, 564.4; 72/412, 416, 469; 174/84 C; 439/877, 882

[56] References Cited

U.S. PATENT DOCUMENTS 3,965,559 6/1976 Mazzola ..... 29/863 X
4,214,361 7/1980 Coldren et al. ..... 29/863
4,815,200 3/1989 Ito ..... 29/863 X

FOREIGN PATENT DOCUMENTS 59-63967 4/1984 Japan .
64-82471 3/1989 Japan .

*Primary Examiner*—Peter Dungba Vo
*Attorney, Agent, or Firm*—Armstrong, Westerman, Hattori, McLeland & Naughton

[57] ABSTRACT

The present invention provides a method of fabricating terminal connected leads by use of various devices such as; a terminal transmitter containing force-fitting terminals at a predetermined pitch from each other and linked by way of respective connecting sections thereof, an intermittent terminal sending mechanism to activate the terminal transmitter for transmitting the force-fitting terminals one by one, and a pressing machine provided with a force-fitting punch and a crimper for firmly connecting the leads to the terminals. The method of the fabrication includes; setting the terminals by intermittently sending each of the terminals with the intermittent terminal sending mechanism; placing one end portion of a predetermined length of each of the leads on one side portion of the individual terminal; pressing and crimping respectively the end portion of the lead and the nonconductive portion thereof by lowering the pressing machine; and separating the thus formed terminal connected leads from the terminal transmitter by cutting the respective connecting sections of the terminals.

5 Claims, 7 Drawing Sheets

METHOD OF FABRICATING TERMINAL CONNECTED LEADS

This application is a continuation of application Ser. No. 07/886,589, filed May 21, 1992, now abandoned.

BACKGROUND OF THE INVENTION

1. Field of the Invention

The present invention relates to a method of fabricating a wire-harness and terminal connected leads composing the wire-harness which are used for an electrical cable distribution system within an automotive vehicle.

2. Description of the Prior Art

Conventionally, the connection between two wire-harnesses or between a wire-harness and another electrical device or the like is performed by engagements of the respective male and mating female connectors thereof, wherein a connector terminal used for the engagement is either of a cramping type or of a force-fitting type. A cramp-type terminal is one in which the nonconductive sheath at one end of a lead is peeled off and then the thus exposed electrically conductive portion thereof and other non-peeled still insulated external portion thereof are respectively cramped by cramping means. The cramping type terminal can not be applied to the connection of signal lines of a CPU circuit or the like, due to the fact that when even one of these signal lines is disconnected by the nonconductive sheath peeling operation, the quality of the lead as a whole can be enormously deteriorated, and that since the diameter of each signal line is so small, the size of the cramping means, or the width and height thereof after the completion of the peeling operation can not effectively be managed. On the other hand, in the case of a force-fitting type terminal, a lead as a whole is first suppressedly inserted into a slot of an electrical contact element, so that side blades of the slot cut into a part of the nonconductive sheath of the lead so as for the lead with be brought into contact to the electrical contact element, which obviates a troublesome insulating cover peeling operation, a strict size management and so on.

FIGS. 7 and 8 indicate one example of a conventional connector in which a force-fitting type terminal is adopted (Japanese Utility Model Application Laid-Open No. 59-63967). In this embodiment, a plurality of force-fitting type terminals a are individually inserted into each of accommodating paths c of a housing b and arranged therein in advance, then a lead d of the corresponding individual terminal is suppressedly inserted from the open area b1 of the housing b into a slot a2 formed in the lead connecting portion a1 of the terminal to be connected thereto. Here, since the accommodating paths c of the housing b are all in the same size, the leads d of the same size only can be suppressedly inserted and brought into contact with the terminals a of the same standards.

Generally, various kinds of terminals and leads of different electric capacity are used in wire-harnesses and terminal connecters thereof adopted for electrical cable distribution system within an automotive vehicle so as to enable the use of various vehicle-mounted type electrical devices, and therefore terminals and leads of various different standards have to be simultaneously used in one connector (housing), the combination of which can be still further variable in accordance with the types, grades of the automobile and also exporting destination thereof. The housing b disclosed in FIGS. 7 and 8 is a connector of the type that contains open portions b1 therein, so that it has to be provided with a plurality of pressing machine that can cope with, for example, various different width of terminals so as to enable the use of terminals and leads of different standards, which not only requires an increase in equipment cost and wider space, but it makes the quality management of the device as a whole substantially difficult.

In view of the foregoing situation, it is an object of the present invention to provide a method of fabricating lead connected terminals which is capable of coping with a change in the standards of the terminals and leads to be used and also provide a high reliability in the connection between these terminals and leads even if each of the leads is of a very small diameter.

In order to attain such an object as described above, the present invention provides a method of fabricating terminal connected leads for connecting a plurality of linked terminals, each of which comprises an electrically contacting portion at one end thereof, and a lead connecting portion at the other end thereof which is composed of a contact element to be brought into contact with the conductive portion of each of the leads and a crimping piece to crimp the nonconductive portion thereof to a plurality of leads by use of various devices such as; a terminal transmitter comprising a carrier strip, and the plurality of force-fitting terminals disposed at a predetermined pitch from each other and respectively connected to the carrier strip by way of respective connecting sections thereof; an intermittent terminal sending mechanism to activate the terminal transmitter for transmitting the terminals one by one; and a pressing machine provided with a force-fitting punch and a crimper, wherein the fabricating method comprising the steps of: setting the force-fitting terminals by intermittently sending each of the terminals with the intermittent terminal sending mechanism; placing one end portion of a predetermined length of each of the leads on the electrically connecting portion of the force-fitting terminal; crimping the lead by the crimping piece and pressing the lead to the contact element by lowering the force-fitting punch and the crimper respectively; and separating the thus formed force-fitting terminals from the carrier strip of the terminal transmitter by cutting the respective connecting sections of the terminals.

The above method further includes the steps of measuring and cutting a plurality of leads to form the shortened leads of a predetermined same length, and cramping and transmitting the shortened leads one by one to the pressing machine to follow.

SUMMARY OF THE INVENTION

In the present invention, since the process of fabricating the lead connected terminals is separately performed from the process of inserting the lead connected terminals into a connector housing, even only one pressing machine can connect various types of terminals and leads regardlessly of the standard of the terminal accommodating path of the housing, in other words, the standards of those terminals and leads. Further, since force-fitting type terminals are used in the present invention, the connection between individual terminal and a lead can be easily processed without peeling the nonconductive sheath of the lead, and therefore even a lead of small diameter can be prevented from facing any class of damage such as disconnection and so on.

The above and other objects, features and advantages of the invention will become apparent from the following description and the appended claims, taken in conjunction with the accompanying drawings which show by way of example preferred embodiments of the invention.

DETAILED DESCRIPTION OF PREFERRED EMBODIMENTS

Figure 1:
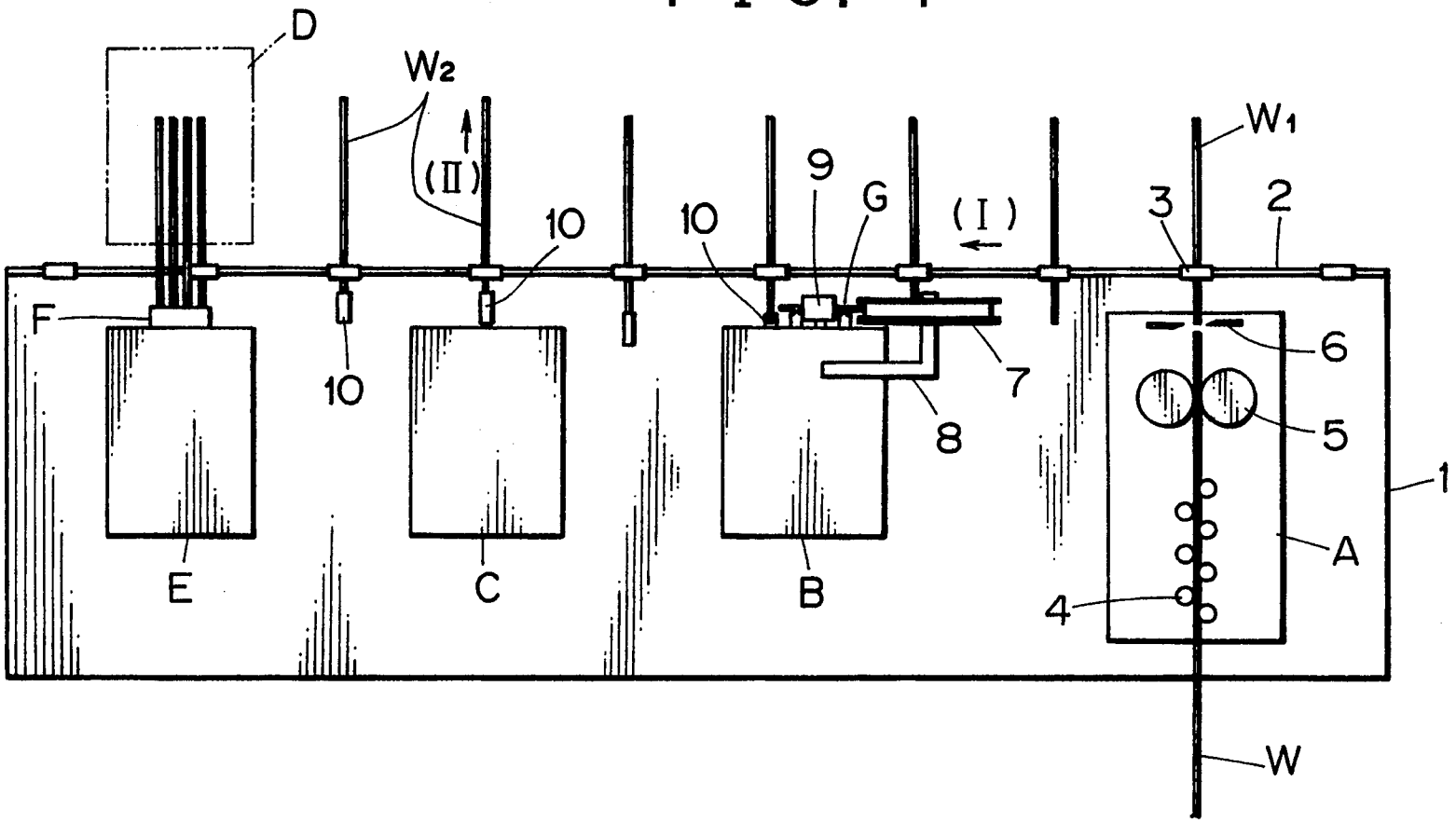
FIG. 1 is a general view showing one embodiment of the whole device used for realization of the present invention.
Figure 2:
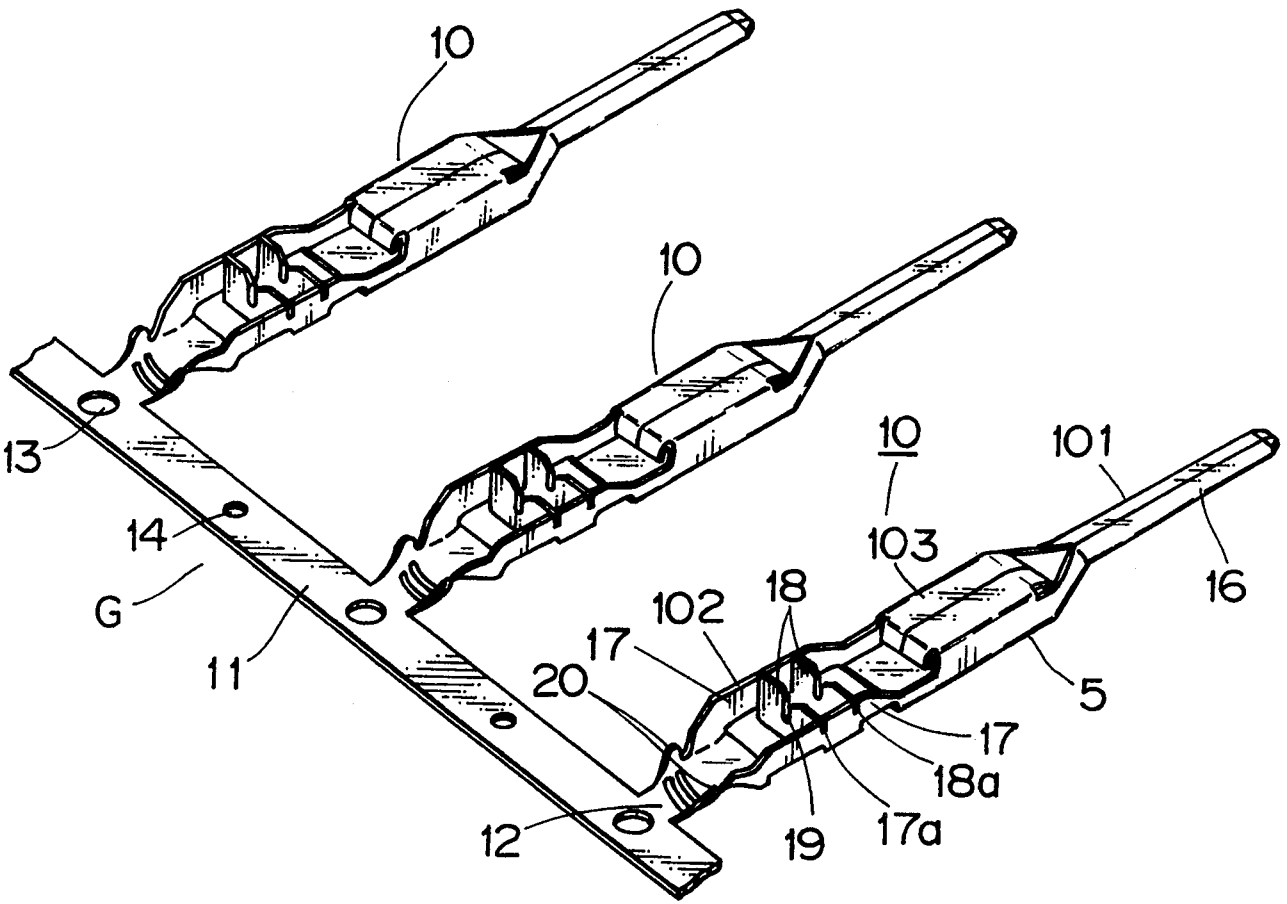
FIG. 2 is a perspective view of important portions of each of the linked terminals used for realization of the present invention.

Referring to the accompanying drawings, FIG. 1 is a general view of the whole device used for executing the present invention, and FIG. 2 illustrates a perspective view of the linked terminals. In FIG. 1, reference numeral 1 denotes a base having a loop-like cramp-containing chain 2 attached thereto at one side thereof, and the cramp-containing chain 2 is formed with a plurality of cramping devices disposed at the same distance from one another for holding the leads W at right angles with the cramp-containing chain provided for fabricating lead connected terminals.

On the base 1, there are mounted (in the order from right to left) a lead measuring and cutting device A that contains a lead W, a plurality of reforming roles 4, length-measuring roles 5 and a cutter 6; a pressing machine B that connects a lead W1, which is cut to a predetermined length by the lead measuring and cutting device A, to a force-fitting type terminal 10: a lead drawer C for withdrawing the thus formed terminal connected lead W2; a lead inserting device D for inserting the force-fitting type terminal 10 of the terminal connected lead W2 into a housing F and a retainer E for holding the housing F.

In the lead measuring and cutting device A, the lead W brought by a reel (not shown) is first corrected at the reforming roles 4 to eliminate its bent or dented portion if any, then measured to a predetermined length by the measuring roles 5, and then cut to be a shortened lead W1 by the cutter 6. This shortened lead W1 is held by the cramping device of the cramp-containing chain 2 and transmitted by one pitch to the direction indicated by an arrow (I), and then connected to the force-fitting type terminal 10 by pressing and crimping operations performed at the pressing machine B. The terminal connected lead W2 is then withdrawn to the direction indicated by an arrow (II) by the lead drawer C, whereby the distance between the force-fitting terminal 10 and the cramping device 3 is thus shortened, the purpose of which is to facilitate the terminal inserting machine D to hold the force-fitting terminal 10 and the lead connected thereto of the shortened terminal connected lead W2. The terminal connected lead W2 withdrawn in the direction indicated by the arrow (II) is transmitted to the terminal inserting device D, and then inserted into a desired terminal accommodating compartment (not shown) within the connector housing F which is fixedly mounted to the retainer E in advance. Repeating these operations above, a wire-harness, in which a plurality of terminal connected leads W2 are incorporated into only one housing F, can be manufactured.

Within those processes of fabricating the wire-harness, since the lead measuring and cutting device A, the lead drawer C, the terminal inserting device D and the retainer E can be all taken from the conventionally disclosed devices, for example, those disclosed in Japanese Patent Laid Open No. 1-13194 or the like, the detailed explanation thereabout is omitted here.

In the pressing machine B, a reel 7 that winds a terminal transmitter G is rotatably held by a reel holder 8, wherein the force-fitting type terminals 10 are sent one by one by an intermittent terminal sending mechanism 9. The terminal transmitter G comprises, as shown in FIG. 2, a plurality of force-fitting terminals 10 disposed at a predetermined pitch which are protruding from one side of a continuous long-size carrier strip 11 by way of connecting sections 12 of the respective terminals 10, and the carrier strip 11 is further formed with a plurality of sending holes 13 and pilot holes 14 therebetween provided for a transmission checking purpose at the same distance from each other, which holes are to be engaged with sending projections (not shown) contained in the intermittent terminal sending mechanism 9. The force-fitting terminal 10 here is embodied as a male terminal, wherein a base plate 15 thereof comprises an electrically contacting portion 101, a lead connecting portion 102 and a tubular abdomen 103, which are respectively provided at one end, the other end, and the intermediate section thereof. The electrically contacting portion 101 is formed with a tab 16 which is constructed such that one free end of the base plate 15 is inwardly folded with respect to the longitudinal direction thereof to form a doubled structure, whereas the lead connecting portion 102 comprises a pair of upright side walls 17, 17 at the other free end of the base plate 15; a pair of contact elements 18, 18 rising from the base plate 15 at right angles with the upright walls 17, 17 and respectively having slots 19 therein; and a pair of non-conducting sheath crimping pieces 20, 20 formed at the rear section of the base plate 15 close to the connecting section 12. The side ends **18*a* of the respective contact elements 18, 18 are engaged with slits 17*a* formed in the respective upright side walls 17, 17. The abdomen 103 is constructed for reinforcing the long-axis force-fitting terminal 10 and forming a fitting portion to be fitted with the terminal accommodating compartment of the connector housing, so that a fitting hole (not shown) is formed in the base plate 15 within the abdomen 103**.

Figure 3:
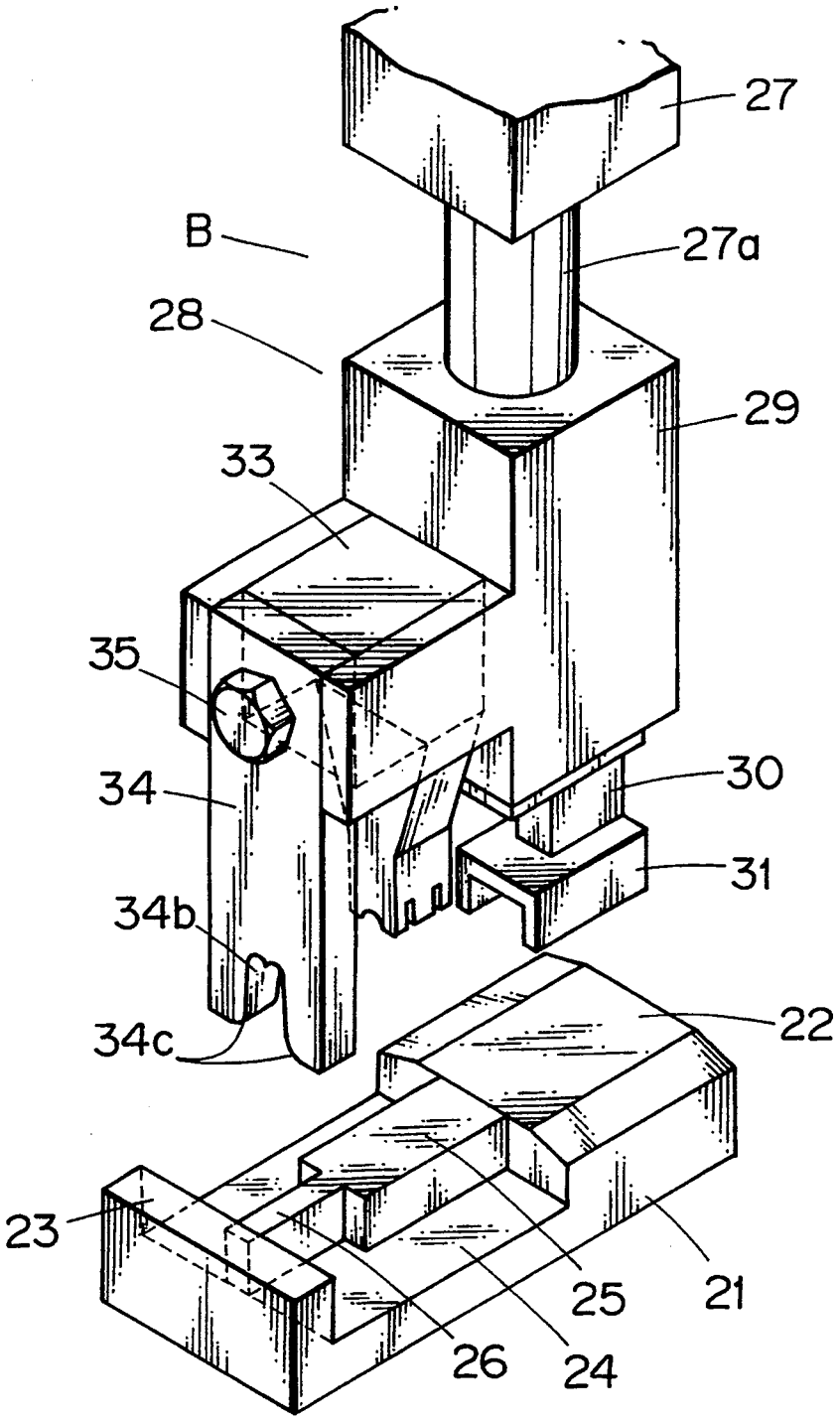
FIG. 3 is a perspective view of a pressing machine B of FIG. 1.
Figure 4:
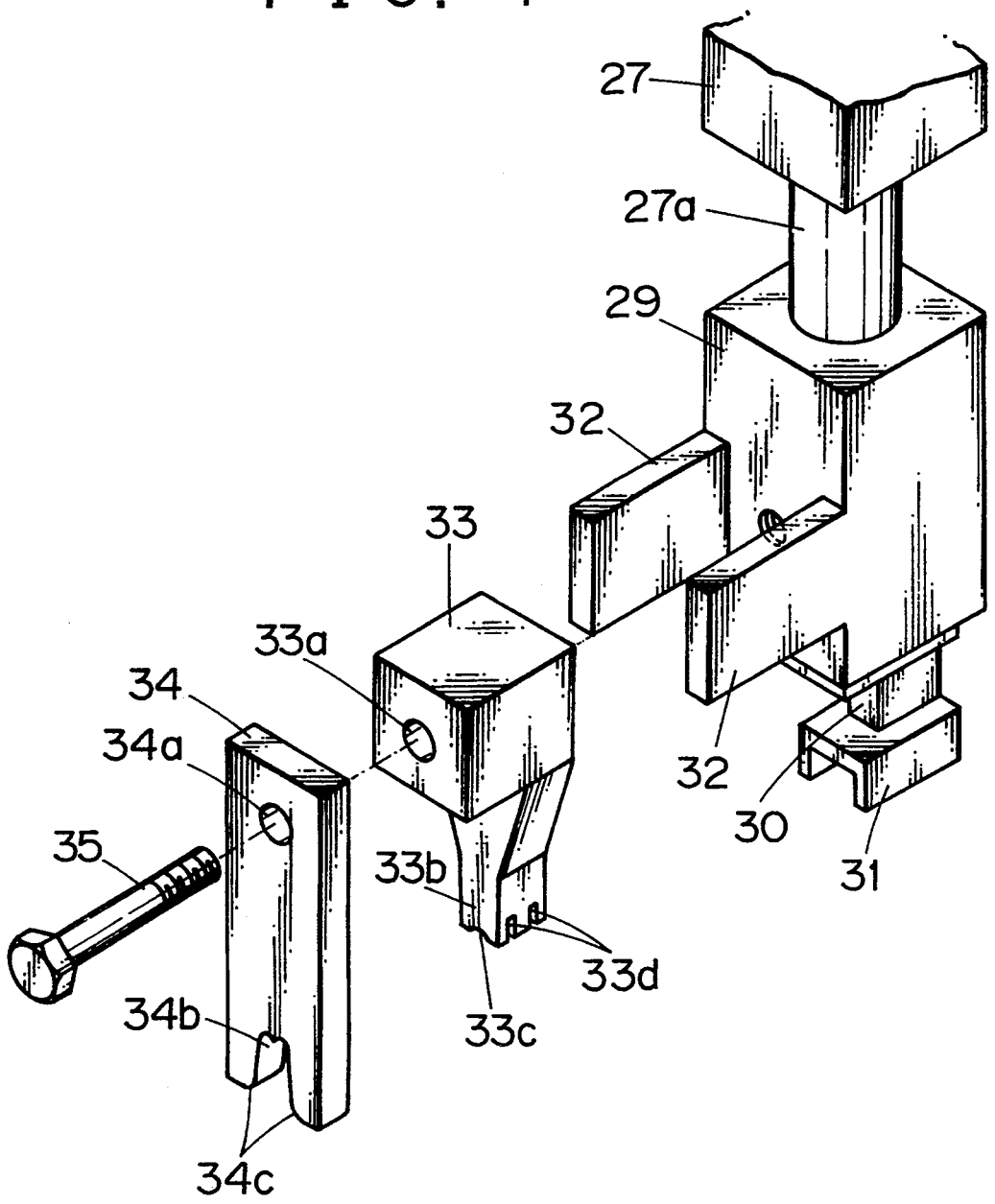
FIG. 4 is an exploded perspective view showing important portions of the pressing machine B of FIG. 3.

FIG. 3 is a perspective view of the pressing machine B, and FIG. 4 is an exploded perspective view showing the important portions thereof. This pressing machine B is composed of a receiving base 21 for receiving the force-fitting terminal 10 therein, and a vertically movable applicator 28 facing thereto. The receiving base 21 further comprises a widened section 22 at one end thereof for receiving the electrically contacting portion 101 and the abdomen 103 of the force-fitting terminal 10; a guide wall 23 for receiving the terminal transmitter G at the other end thereof, and receiving sections 25, 26 which are protruding from the intermediate dented portion 24 for respectively receiving a pair of contact elements 18, 18 and the nonconductive sheath crimping pieces 20, 20 therein. The applicator 28 is composed of a vertically movable main body 29 which is threadedly attached to a piston rod 27*a* of an air-cylinder 27; a terminal suppressor 31 having an R-form sectional surface disposed by way of a supporting pillar 30 at the bottom surface of the main body 29; and a force-fitting punch 33 and a nonconductive sheath crimper 34 superposed on the force-fitting punch 33 by a bolt 35, both being disposed between side walls 32, 32 protruding from the front surface of the main body 29. The terminal suppressor 31 is disposed resiliently displaceable in the vertical direction by a suppressed coil (not shown) provided between the supporting pillar 30 and the main body 29 of the applicator 28. The force-fitting punch 33 is constructed such that a force-fitting projection 33*b* of a narrow width is disposed at the lower end of a plate-like main body thereof and having a bolt hole 33*a*, wherein disposed at the lower end surface of the force-fitting projection 33*b* are a lead pressing groove 33*c* and a pair of grooves 33*d*, 33*d* to be faced with the pair of contact elements 18, 18 of the force-fitting terminal 10. Further, the nonconductive sheath crimper 34 is also formed with a substantially counter w-shaped crimp groove 34*b* at the lower end surface of the plate-like main body thereof and having a bolt hole 34*a*, wherein the crimp groove 34*b* is formed with an insertion guide section 34*c* by making the open lower end thereof in a rather round (R) shape, whose groove width gets narrower gradually towards the top portion thereof, thereby making a taper form.

Now, the force-fitting or crimping operation of the lead applied to the force-fitting terminal by use of the pressing machine B is explained below referring to FIGS. 5 and 6.

First, before or simultaneously transmitting a shortened lead w1 to the pressing machine B as shown in FIG. 1, the force-fitting terminals 10 are correctly placed on the receiving base 21 of the pressing machine B one by one, wherein these terminals 10 are transmitted step by step along with the guide wall 23 in accordance with the movement of the carrier strip 10 of the terminal transmitter G, which is activated by the intermittent terminal sending mechanism 9 (refer to FIG. 1). In this occasion, it is checked that the force-fitting terminal 10 is correctly placed on the receiving base 21 by the before-explained sending holes 13 and the pilot holes 14.

Figure 5:
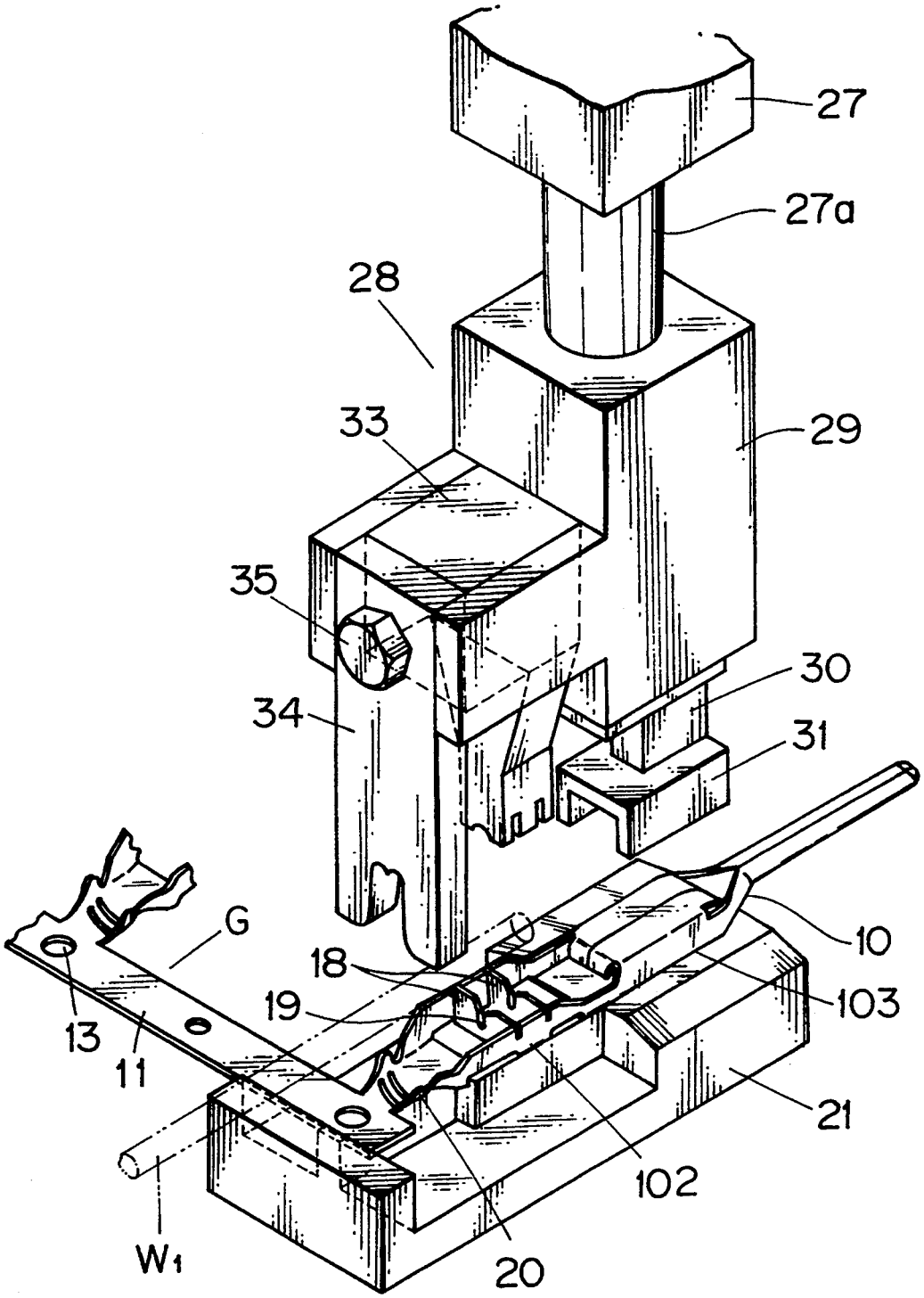
FIG. 5 is a perspective view showing the state of a lead before being connected to the terminal by the pressing machine B.

Then, as shown in FIG. 5, an end portion of the shortened lead W1 is placed on the lead connecting portion 102 of the force-fitting terminal 10. Thereafter, as shown in FIG. 6, when the applicator 28 is lowered by an activation of the air-cylinder 27 (refer to FIG. 3), the terminal suppressor 31 is lowered to press the abdomen 103 of the terminal, and also the force-fitting punch 33 and the nonconductive sheath crimper 34 are lowered simultaneously so as to suppressingly insert the conductive portion of the shortened lead W1 into and connect to the slot 9 of the pair of contact elements 18, 18 of the force-fitting terminal 10, so that the external nonconductive portion of the lead W1 is crimped and fixed by the pair of crimping pieces 20, 20. After or simultaneously force-fitting and crimping the lead, the connecting section 12 is cut off by a cutter (not shown) disposed in the front portion of the applicator 28, so that the terminal is separated from the carrier strip 11.

The terminal connected lead W2 formed by force-fitting or cramping the force-fitting terminal 10 is transmitted by the cramp-containing chain 2 as shown in FIG. 1, and then required further processes are performed by the lead drawer C and the terminal inserting device D.

Figure 6:
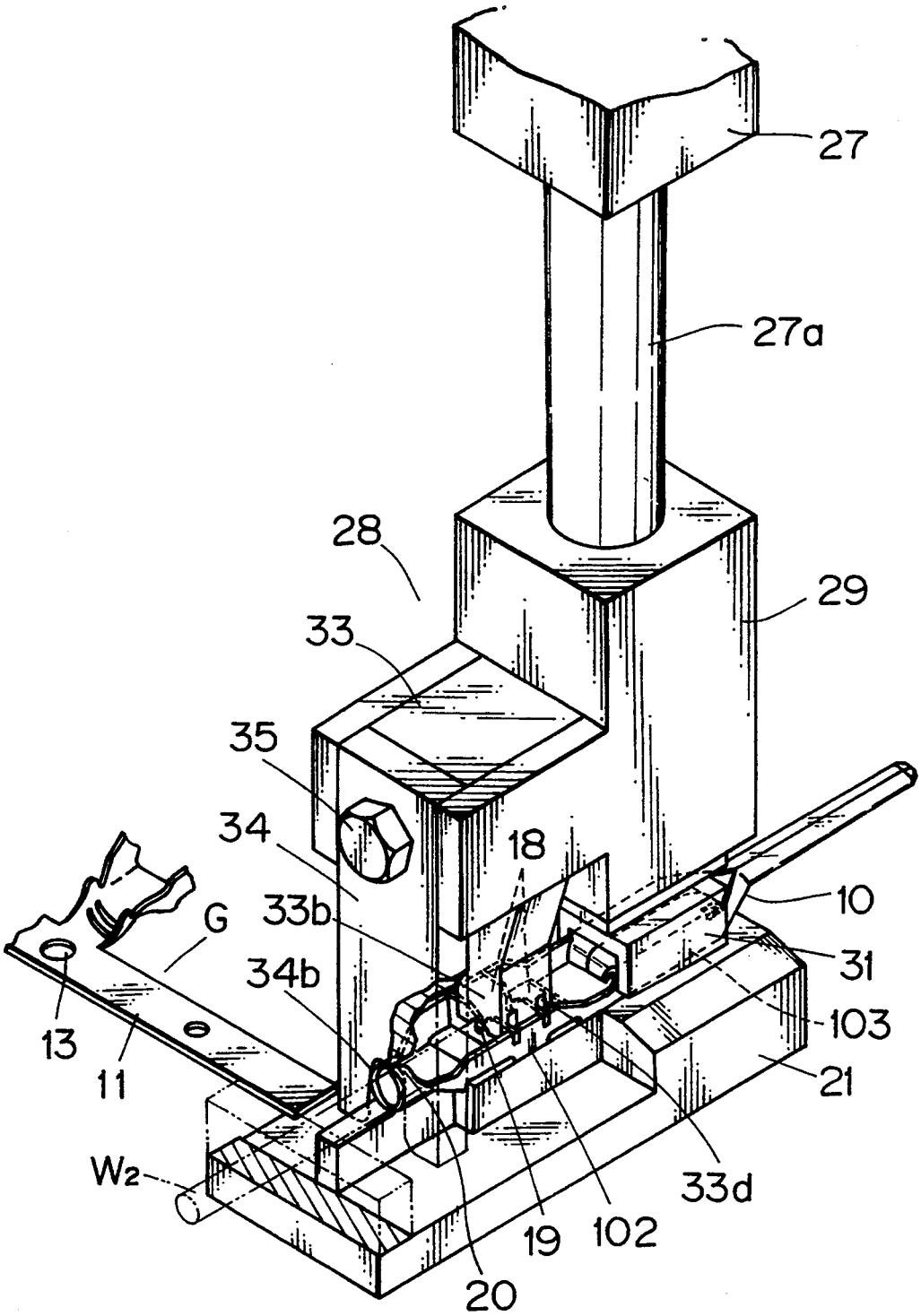
FIG. 6 is a perspective view showing the state of the lead, after it is connected to the terminal by the pressing machine B.
Figure 7:
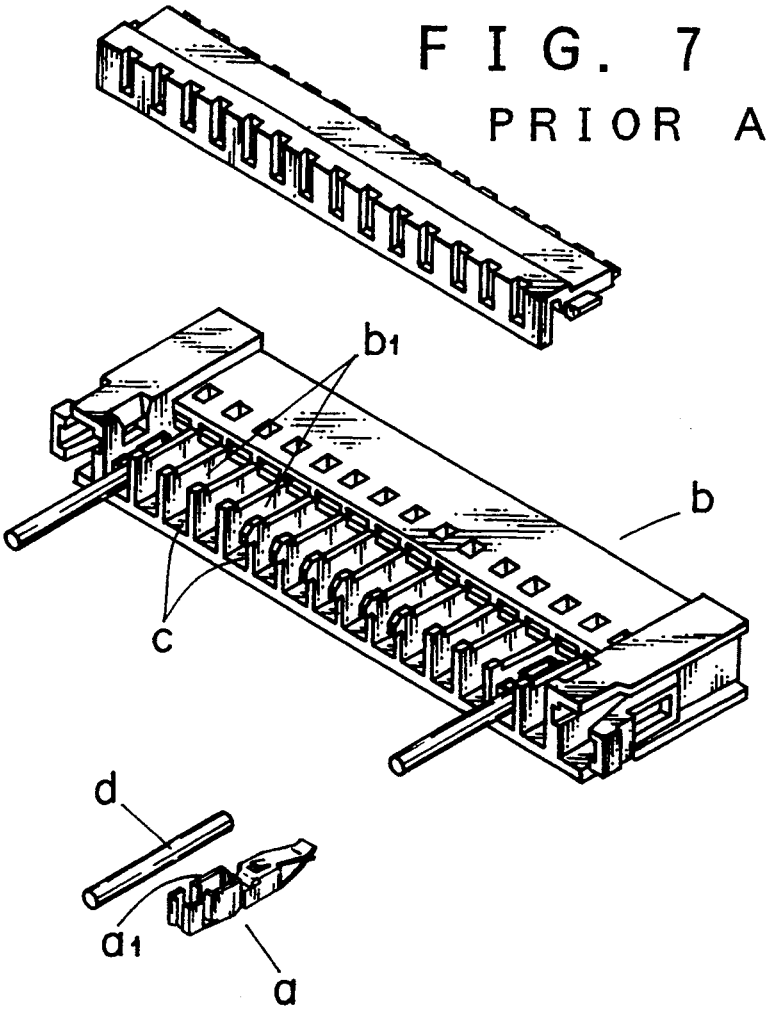
FIG. 7 PRIOR ART
FIG. 7 is an explanatory view showing a connector of a wire-harness adopting conventional force-fitting terminals.
Figure 8:
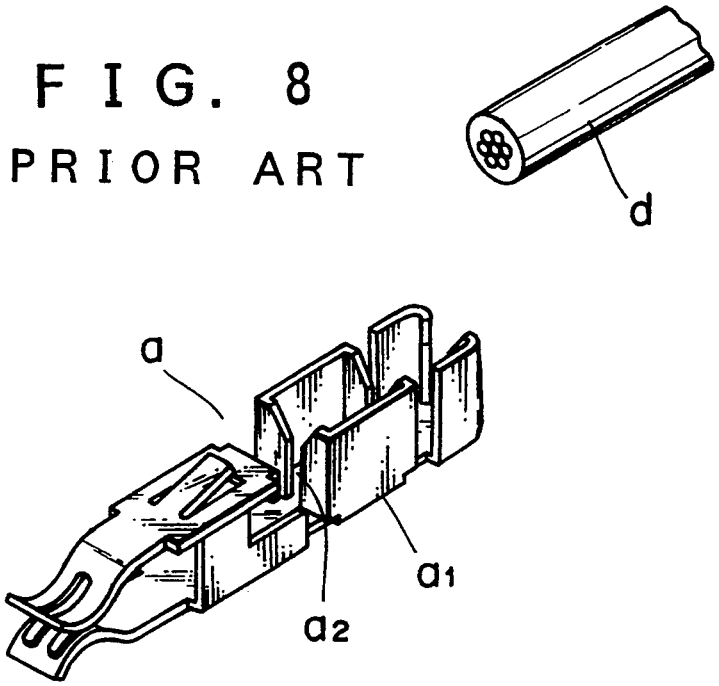
FIG. 8 PRIOR ART
FIG. 8 is an expanded perspective view showing the individual force-fitting terminal of FIG. 7.

As is obvious by FIGS. 5 and 6, the connection between the force-fitting terminal 10 and the shortened lead W1 is performed irrespective of the size of the (terminal accommodating compartment of the) connector housing F, whereby a change in the standards of the force-fitting terminal 10 can be easily coped with by replacing the force-fitting punch 33 and the nonconductive sheath crimper 34 to be mounted to the main body 29 of the applicator 28 with those of other standards. Furthermore, even though the specification of the force-fitting terminal 10 is partially altered, those components such as the force-fitting projection 33*b* and the crimp groove 34*b* respectively of the force-fitting punch 33 and the nonconductive sheath crimper 34 can be used as they are due to their structural features thereof. Still further, although only one lead measuring and cutting device A and a pressing machine B are disclosed in FIG. 1 in order to avoid the complication of the drawing, in fact, these equipments can be pluralized so as to connect leads and force-fitting terminals 10 of various different standards. By the way, although the terminal transmitter G is disclosed as a plurality of linked force-fitting terminals 10, it can be constructed such that the both electrically contacting portion 10, and lead connecting portion 102 are formed with connecting section 12 respectively.

As explained heretofore, in a method of fabricating terminal connected leads according to the present invention, a force-fitting type terminal is adopted instead of a conventionally used cramp-type terminal, wherein the force-fitting terminal is connected to a lead in a separate process from that of the installation thereof to the connector housing, so that even in a case of a lead of small diameter, the electrical connection thereof to the force-fitting terminal is substantially reliable and effective. Further, since the fabricating thereof is performed in the open state, only one pressing machine can electrically connect various types of leads and terminals just by replacing some parts of the force-fitting punch and the crimper of the pressing machine.

Having now fully described the present invention, it will be apparent to one of ordinary skill in the art that many changes and modifications can be made thereto without departing from the spirit and scope of the invention as set fourth herein.

What is claimed is:

1. A method of fabricating terminal connected leads for connecting leads to force-fitting terminals comprising:

providing a plurality of leads each having a conductive portion surrounded by a nonconductive portion;

providing a plurality of force-fitting terminals connected at a respective connecting section thereof and at predetermined intervals to a carrier strip, each force-fitting terminal comprising at one end an electrically contacting portion having a contact element for contacting the conductive portion of a respective lead, and at another end a lead connecting portion for connecting to a respective lead, the lead connecting portion of each force-fitting terminal having a crimping portion for crimping the nonconductive portion of the respective lead;

intermittently feeding with an intermittent feeder said plurality of force-fitting terminals connected to said carrier strip to a terminal receiving base of a pressing machine;

placing an end portion of a lead of predetermined length, on the electrically contacting portion of each respective terminal fed to said terminal receiving base, said end portion placed on said electrically contacting portion having both said conductive and nonconductive portions;

pressing each lead to each respective terminal with a pressing machine, the pressing machine comprising a force-fitting punch section and a crimper section, wherein the force-fitting punch section acts such that the end portion of the lead is pressingly fitted to the electrically contacting portion of the respective terminal so that the contact element of the terminal penetrates the nonconductive portion of the respective lead and contacts the conductive portion of the lead, and wherein the crimper section acts to crimp the crimping portion of the lead connecting portion of the respective terminal so that the nonconductive portion of the lead is fixedly held by the crimping portion of the respective terminal;

separating each force-fitting terminal while attached to the respective lead from the carrier strip by cutting the respective connecting section of each terminal;

wherein said step of pressing each lead to each respective terminal comprises pressingly fitting each end portion of each lead into the terminal contact element which has at least one slit formed in at least one upright wall extending transversely therein, the force-fitting punch section acting such that the at least one slit cuts through the nonconductive portion of the end portion of the respective lead so that the at least one upright wall contacts the conductive portion of the lead; and wherein said force-fitting punch of the pressing machine comprises at least one groove complementary to said at least one upright wall of the respective terminal, such that in the pressing step, the force-fitting punch is lowered so that the lead is and the at least one upright wall extends at least in part into the at least one complementary groove of the force-fitting punch.

2. The method of fabricating terminal connected leads according to claim 1, wherein the step of providing the plurality of leads comprises:

measuring and cutting an elongated lead to form the plurality of leads; and cramping each measured and cut lead with a cramping device; and transporting the cramped leads one by one to the pressing machine.

3. The method of fabricating terminal connected leads according to claim 2, further comprising:

withdrawing each terminal connected lead in a first direction so as to shorten a distance between each force-fitting terminal and the cramping device;

transporting each withdrawn and cramped terminal connected lead to a terminal inserting device;

inserting the respective terminal of each terminal connected lead into a terminal accommodating compartment of a connector housing.

4. The method of fabricating terminal connected leads according to claim 1, wherein in said pressing step the at least one upright wall is two walls each having a respective slit therein for accommodating the lead and wherein the at least one complementary groove of the force fitting punch comprises two grooves complementary to said two walls of the respective terminal, said two walls extending into said two force-fitting punch grooves in said pressing step so that said two walls cut through two separate areas of the nonconductive portion of the lead so as to create contact between said two walls and respective conductive portions of the lead.

5. The method of fabricating terminal connected leads according to claim 4, said step of intermittently feeding said plurality of force-fitting terminals comprises intermittently feeding said plurality of force-fitting terminals from a reel, said force-fitting terminals extending orthogonally from said carrier strip and said carrier strip having a plurality of sending holes and pilot holes therealong for engaging with sending projections of the intermittent feeder.

* * * * *